United States Patent [19]

Haftmann et al.

[11] Patent Number: 4,958,949

[45] Date of Patent: Sep. 25, 1990

[54] DRIVE ELEMENT FOR PLATENS OF TYPEWRITERS OR SIMILAR OFFICE MACHINES

[75] Inventors: Johannes Haftmann, Schwabach; Rudolf Schmeykal, Hemhofen, both of Fed. Rep. of Germany

[73] Assignee: TA Triumph-Adler Aktiengesellschaft, Nurenberg, Fed. Rep. of Germany

[21] Appl. No.: 343,698

[22] Filed: Apr. 27, 1989

[30] Foreign Application Priority Data

May 4, 1988 [DE] Fed. Rep. of Germany ..... 3815066

[51] Int. Cl.[5] ..... B41J 19/80

[52] U.S. Cl. ..... 400/314; 400/545; 400/564; 400/572; 400/574

[58] Field of Search ..... 400/313, 314, 314.2, 400/314.6, 315, 545, 553, 564, 564.1, 569, 570, 572, 575.2, 576, 649, 314.1, 314.3, 314.4, 314.5

[56] References Cited

U.S. PATENT DOCUMENTS 3,763,987 10/1973 Kunst et al. ..... 400/574.1

4,388,007 6/1983 Meier et al. ..... 400/314.6

FOREIGN PATENT DOCUMENTS 3014609 12/1981 Fed. Rep. of Germany ..... 400/314

OTHER PUBLICATIONS

IBM Technical Disclosure Bulletin, vol. 30, No. 3, Aug., 1987.

*Primary Examiner*—Edgar S. Burr

*Assistant Examiner*—Ren Yan

*Attorney, Agent, or Firm*—Browdy and Neimark

[57] ABSTRACT

The present invention relates to a drive element of typewriters or similar office machines where the movement of the platen is derived from the movement of the carriage. In the past numerous drive elements have been required in devices of this type, which required a considerable assembly effort and bearing effort. In contrast hereto the drive element proposed is formed in one piece as a one-armed lever which is rotatably disposed coaxially with the platen and with the line space wheel disposed thereon and which has at least one ratchet which is in operative contact with the line space wheel. A displacement element disposed on the carriage of the machine comes into operative contact with the one-armed lever within a set movement range of the carriage and pivots it, so that the turning of the platen takes place by means of the ratchet.

8 Claims, 3 Drawing Sheets

DRIVE ELEMENT FOR PLATENS OF TYPEWRITERS OR SIMILAR OFFICE MACHINES

BACKGROUND OF THE INVENTION

1. Field of the Invention

The present invention relates to a drive element for the platen of a typewriter or similar office machine having a movable carriage, the drive element being in operative contact via a ratchet with a line space wheel disposed on the shaft of the platen and being acted upon by a force causing the movement of the platen based on the movements of the carriage.

2. The Prior Art

In general, two different systems for turning the platen by means of drives disposed on the machine are customary in machines of the above mentioned type. One system provides a motor in the machine which acts via a corresponding drive element on a toothed wheel which is connected, fixed against rotation, with the platen. The advantage of this system lies in general in that, given a suitable motor and a suitable control, the platen can be turned around angles of rotation of almost any desired smallness. This solution is disadvantageous in that high costs are involved.

The second system for performing the paper transport by turning of the platen provides a line space wheel disposed on the platen and connected with it, fixed against rotation, which is in an operative contact with a ratchet. Often a magnet disposed on the machine is provided for the operation of the ratchet which pulls the ratchet, which is acted upon by a spring, out of its position of rest into its operative position and thus turns the line space wheel and, along with it, the platen by a set angle of rotation. Another solution provides that the ratchet, which is also acted upon by a spring, is connected via a drive chain with a pivot element, which is pivotable by means of the movement of the carriage and pulls in this way the ratchet out of its position of rest into its operative position, so that here, too, the platen is turned by a set angle of rotation. Such an arrangement can be found, for example, in German Published, Nonexamined Application DE-OS 20 59 154.

Compared with the others, the last recited possibility of turning the platen and thus accomplishing the movement of the paper is by far the most cost effective. However, it is disadvantageous that a very great effort is required to provide bearings for the individual drive elements and furthermore, that inexactness because of wear must be expected.

SUMMARY OF THE INVENTION

It is therefore an object of the invention to recite a drive element for a typewriter or similar office machine having a movable carriage which is in the form of a single piece and requires only a small amount of bearings.

This object is attained by the arrangement in which the drive element has a recess by means of which it is supported fixed against rotation on the platen shaft. The drive element also has a transport surface which can be acted upon by an element disposed on the carriage so that the drive element pivots around the platen shaft out of a position of rest into an operative position. A resilient element is disposed on the drive element which is supported on the frame of the machine and which maintains the drive element in its position of rest. At least one ratchet in the form of a resilient arm is disposed on the drive element, which is inoperative contact with the line space wheel and which pivots the ladder around a set angle of rotation when the drive element moves out of its position of rest into its operative position or from its operative position into its position of rest. Advantageous embodiments of the drive element are recited in the dependent claims.

The drive element according to the present invention is particularly advantageous because it is formed as one piece and requires a minimal amount of bearings. Additionally, it can be manufactured cost-effectively of plastic by injection molding. An improvement of the drive element in which a second ratchet in the form of a resilient arm is disposed on the drive element, the operative surfaces of the ratchets being located centrically symmetrical to each other in reference to the pivot point of the drive element, so that both ratchets pivot the line space wheel around a set angle of rotation during the movement of the drive element out of its position of rest into its operative position or from its operative position into its position of rest, further increases the operational reliability.

The embodiment of the drive element in which a catch element is shaped out of the drive element which is in operative contact with a catch wheel disposed, fixed against rotation, on the platen shaft, the connection between the drive element and the catch element being in the form of a resilient element and the catch element being maintained in its operative position by means of support elements, fixedly attached to the frame of the machine, and such a way that the catch element mainly moves only in a radial direction in relation to the platen shaft when the catch wheel is turned from one catch position to the next catch position makes it possible to accomplish not only the paper transport with the one-piece drive element, preferably manufactured of plastic by injection molding, but also the catch of the platen, which is regarded as particularly cost-effective and thus also advantageous.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DETAILED DESCRIPTION OF THE PREFERRED EMBODIMENTS

Figure 1:
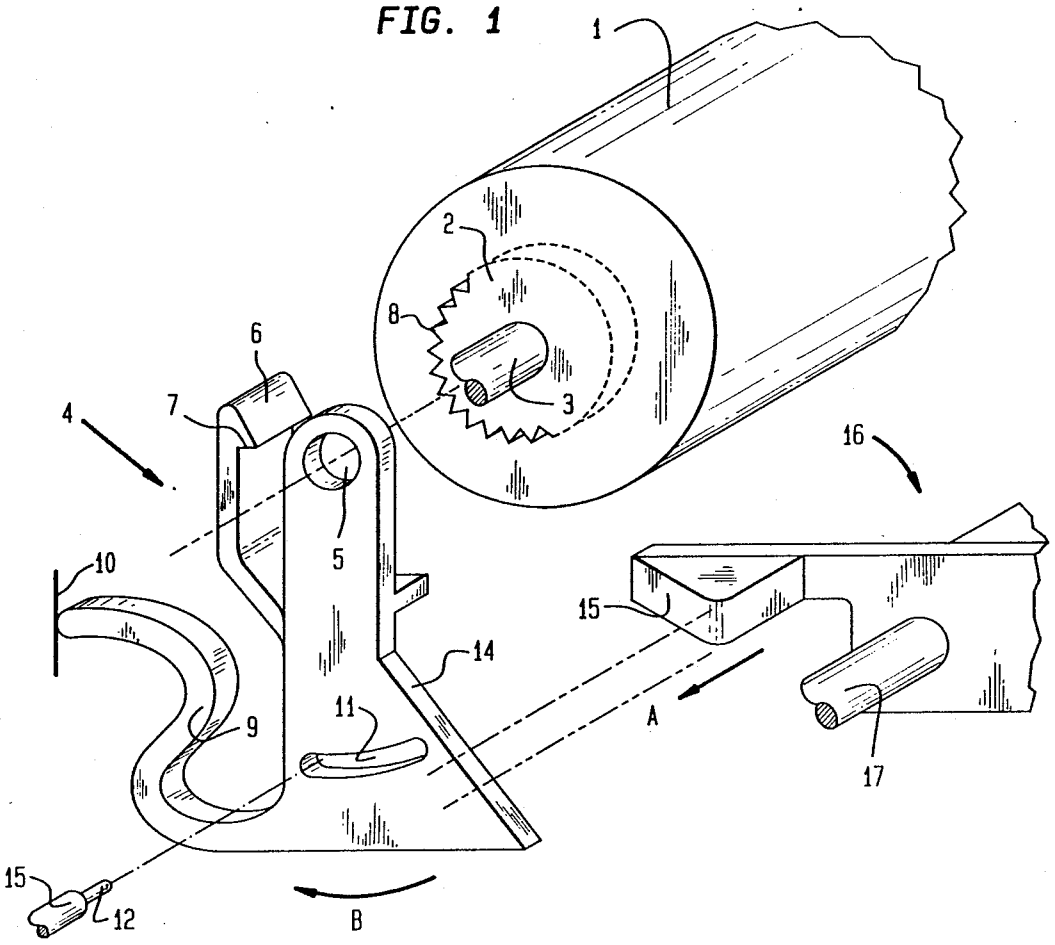
FIG. 1 is a schematic view of a first drive element with a ratchet.

FIG. 1 shows in extended schematic view, a platen 1 with a line space wheel 2 disposed thereon. A drive element 4 in the form of a one-armed lever, is rotatably disposed by means of a recess or hole 5 on the shaft 3 of the platen 1. A ratchet 6 is formed on the drive element as a resilient arm. The ratchet 6 interacts with the line space wheel 2 in such a way that the operative surface 7 of the ratchet 6 abuts against a steep flank 8 of a tooth of the line space wheel 2.

On the side of the drive element 4 pointing away from the recess 5, a resilient arm 9 is formed on the same side on which the ratchet 6 is also located. The free end of the resilient arm 9 is supported by an abutment 10 located on the typewriter frame. Also on the end of the drive element 4 which points away from the recess 5, an oblong slot 11 is located on a circle relative to the recess 5, into which extends a tapered end 12 of a pin 13 fixedly disposed on the frame in such a way that the resilient arm 9 is slightly pre-stressed.

An oblique transport face 14 is formed on the side of the drive element 4 pointing away from the resilient arm 6, which can be brought into interaction with a transport element 15 disposed on the carriage 16. Now if the carriage 16 is moved in the direction of the arrow A on its guide 17, the transport element 15 displaces the drive element 4 against the force of the resilient arm 9 via the oblique transport face 14, so that the drive element performs a pivotal movement in the direction of the arrow B. In the course of this pivotal movement and while the platen 1 is maintained in its position by a catch (not shown), the ratchet 6 is moved along the gently inclined side of the next tooth of the line space wheel 2 sufficiently far so that the operative surface 7 of the ratchet 6 comes into operative contact with the steep flank of this next tooth of the line space wheel 2. In this movement the drive element 4 is guided by the tapered end 12 of the pin 13 and is supported against it. If now the carriage is returned opposite to the direction of the arrow A, the resilient arm 9 presses the drive element 4 back into its original position. The ratchet 6 turns the line space wheel 2 and with it the platen 1 by one tooth pitch against the catch (not shown).

To keep wear between the oblique transport face 14 and the transport element 15 as small as possible, they are matched in their shapes.

Figure 2:
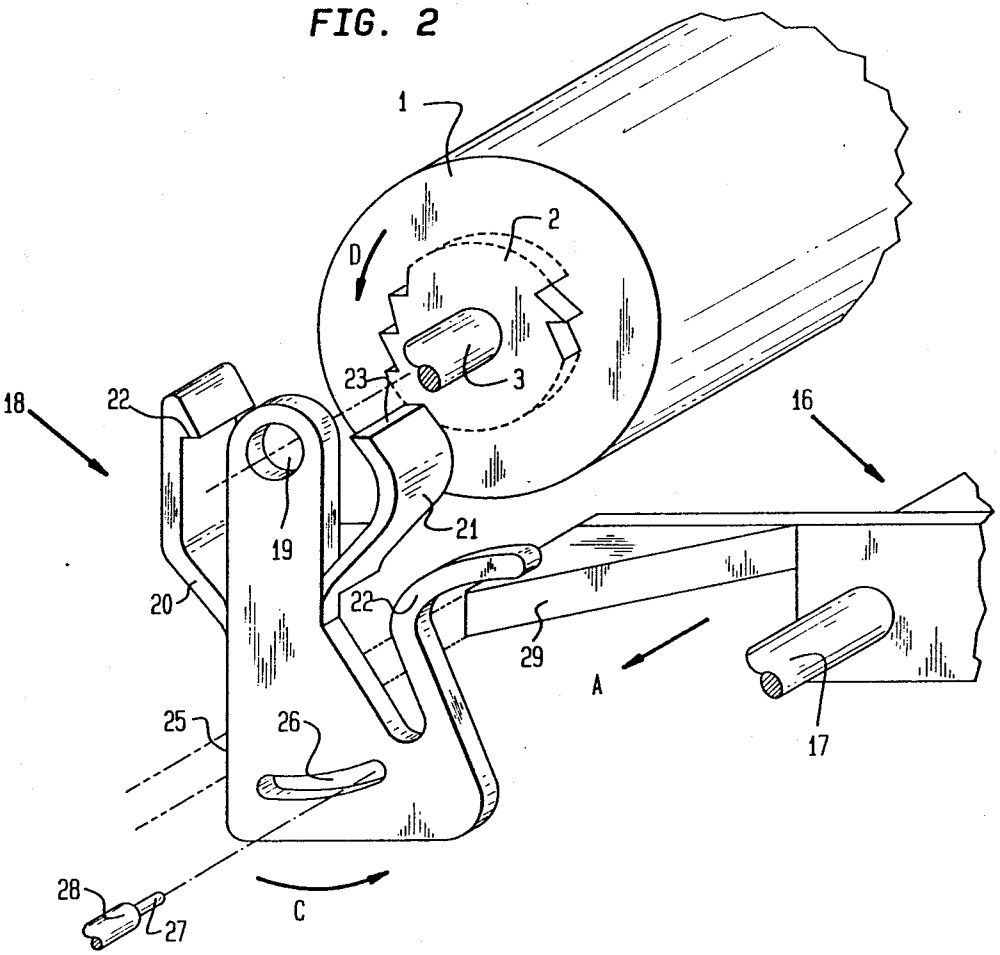
FIG. 2 is a schematic view of a second drive element with two ratchets.

In FIG. 2 also in an extended view, a line spacing mechanism for, for example, a typewriter is shown. Because some components are identical with those shown in FIG. 1, identical reference numerals are used for these.

A drive element 18 in the form of a one-armed lever is pivotably supported by means of a recess or hole 19 on the shaft 3, which supports the line space wheel 2 and the platen 1. Two ratchets 20, 21 in the form of resilient arms are disposed on the drive element 18. The ratchets 20, 21 are connected with the line space wheel in such a way that their operative surfaces 22, 23 abut against the steep flanks of two teeth disposed opposite each other on the circumference of the line space wheel 2. On the side pointing away from the recess 19 of the one-armed lever a resilient arm 24 is formed on the one side relative to the path of movement of the one-armed lever, which is supported against an abutment (not shown) disposed on the typewriter frame (not shown). On the opposite side of the drive element 18, a transport element 25 is provided. Also on the side pointing away from the recess 19, an oblong slot 26 is provided on a circle relative to the recess 19, into which extends a tapered end 27 of a pin 28 fixedly disposed on the frame in such a way that the drive element 18 is slightly pre-stressed against the typewriter frame by means of the resilient arm 24.

Now if the carriage 16 is moved on its guide 17 in the direction of the arrow A, an oblique transport face 29 disposed on the carriage 16 comes into contact with the transport element 25 and pivots the drive element in the direction of the arrow C. In the course of this pivot movement, the line space wheel 2 and with it the platen 1 are turned in the direction of the arrow D against a catch (not shown). The movement of the carriage 16 in the direction A is calculated in such a way that the turning movement of the platen 1 or of the line space wheel 2 is slightly more than a tooth pitch. If the carriage is moved opposite to the direction of the arrow A, the drive element 18 pivots back into its original position because of the spring force of the resilient arm 24. In this case, the ratchets 20, 21, which are in the form of resilient arms are pulled across the flat flanks of the teeth of the line space wheel 2, held in position by the catch (not shown) until the operative surfaces 22, 23 come into operative contact with the respectively next steep tooth flank. During the pivotal movement of the drive element 18 the latter is supported against the pin 28 fixed on the housing and is guided by it.

Figure 3:
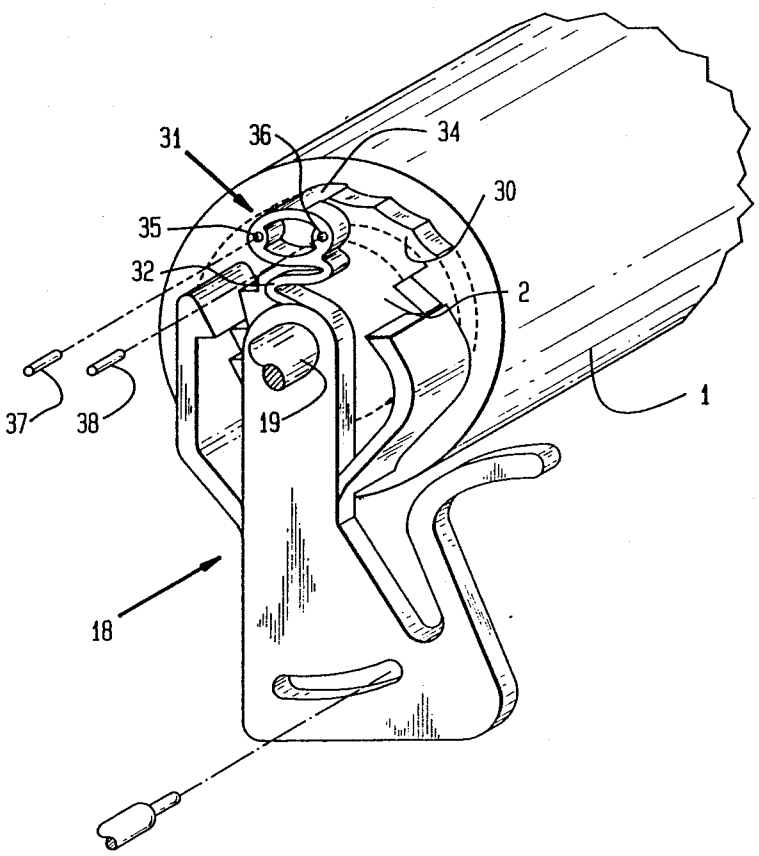
FIG. 3 is a schematic view of a third drive element with the catch disposed thereon.

An exemplary embodiment for a drive element made in one piece together with a catch element is shown in FIG. 3. Because essential portions of FIG. 3 correspond to the representation in FIG. 2, only the differences are described in detail below.

A catch wheel 30 is disposed, fixed against rotation, on the typewriter shaft between the front face of the platen 1 and the line space wheel 2 and coaxially to them. The drive element 18 has on its side which is provided with the recess 19, a tab 32 in the form of a spring element, which supports a catch element 31. The catch element 31 is provided with two bores 35 and 36 on its side which is connected with the tab 32, into which extend pins 37, 38, which are fixed on the frame, and supports a resilient finger 34 which is shaped out of the material of the element, extends parallel to the surface of the platen and is in operative contact with the catch wheel 30.

Now if the drive element 18 is pivoted, as described in FIG. 2, this can take place because of the resilient construction of the tab 32 and without the catch element 31, which is fastened by the pins 37, 38 fixed to the frame, following this movement. The turning movement of the line space wheel 2 and with it of the catch wheel 30, caused by the pivot movement of the drive element 18, only causes the resilient finger 34 of the catch element 31 to be first pushed radially outward by the teeth of the catch wheel 30 and, at the end of the turning movement, to come to rest in the next pitch of the catch wheel 30.

The reason for this design of the drive element 18 mainly lies in that it provides a simple way to design the catch and above all in that the catch element and the drive element can be made as one piece, which considerably reduces the assembly effort.

Obviously the drive elements shown in FIGS. 1 to 3 are only given as examples which can be varied by one skilled in the art, in particular when the surroundings are correspondingly redesigned, without departing from the basic scope.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A drive device for the platen of an office imprinting machine having a movable type-carrier carriage, the platen having a line-space wheel fast therewith, the device comprising a drive element pivotally mounted on the shaft of the platen, the drive element having a resilient arm engageable with a fixed abutment acting in use to urge the drive element into a normal position of rest, the drive element also having at least one ratchet co-operable with the said ratchet, the drive element having transport element engageable by a part of the carriage so that at the end of carriage movement in one direction the said carriage part engages the said element and displaces the drive element angularly against the action of the resilient arm, which returns the drive element to its rest position upon return movement of the carriage, the said ratchet effecting rotation of the platen and wheel through one line-space in the course of movement of the drive element away from and back to its position of rest.

2. A drive device according to claim 1, wherein the drive element is provided with two ratchet arranged to engage with diametrically opposed teeth on the line-space wheel and to act in unison with each other.

3. A drive device in accordance with claim 2, wherein said drive element is a one-piece, plastic injection-molded part.

4. A drive device according to claim 2, wherein the drive element further comprises a catch element connected to the remainder of the drive element in a manner permitting relative angular movement, the catch element being held in fixed position relative to the machine frame in use of the device a catch wheel fast with the platen and having a notched periphery, the catch element comprising a resilient finger pin engageable with the notched periphery of the catch wheel, the resilient finger serving to restrain the platen against unwanted rotation, but flexing radially outwardly to ride from one notch in the wheel to the next when the platen is positively rotated by the drive element.

5. A drive device in accordance with claim 4, wherein said drive element is a one-piece, plastic injection-molded part.

6. A drive device according to claim 1, wherein the drive element further comprises a catch element connected to the remainder of the drive element in a manner permitting relative angular movement, the catch element being held in fixed position relative to the machine frame in use of the device, a catch wheel fast with the platen and having a notched periphery, the catch element comprising a resilient finger engageable with the notched periphery of the catch wheel, the resilient finger serving to restrain the platen against unwanted rotation, but flexing radially outwardly to ride from one notch in the wheel to the next when the platen is positively rotated by the drive element.

7. A drive device in accordance with claim 6, wherein said drive element is a one-piece, plastic injection-molded part.

8. A drive device in accordance with claim 1, wherein said drive element is a one-piece, plastic injection-molded part.

* * * * *